US006030253A

United States Patent [19]

Katoh

[11] Patent Number: 6,030,253

[45] Date of Patent: Feb. 29, 2000

[54] CONNECTOR FOR FLEXIBLE PRINTED CIRCUIT BOARD

[75] Inventor: Naoki Katoh, Miyagi-ken, Japan

[73] Assignee: Alps Electric Co., Ltd., Tokyo, Japan

[21] Appl. No.: 09/181,344

[22] Filed: Oct. 28, 1998

[30] Foreign Application Priority Data

Nov. 7, 1997 [JP] Japan ..... 9-305852

[51] Int. Cl.[7] ..... H01R 9/07

[52] U.S. Cl. ..... 439/493; 439/67

[58] Field of Search ..... 439/493, 67, 77, 439/329

[56] References Cited

U.S. PATENT DOCUMENTS

| | | | |
|---|---|---|---|
| 3,745,509 | 7/1973 | Woodward et al. | 439/493 |
| 3,988,648 | 10/1976 | Robinson . | |
| 4,379,608 | 4/1983 | Olsson et al. | 439/67 |
| 5,211,577 | 5/1993 | Daugherty | 439/493 |
| 5,707,241 | 1/1998 | Hamlin et al. | 439/67 |
| 5,730,619 | 3/1998 | Hamlin | 439/493 |

FOREIGN PATENT DOCUMENTS 4-36779 3/1992 Japan .

*Primary Examiner*—Paula Bradley
*Assistant Examiner*—Tho D. Ta
*Attorney, Agent, or Firm*—Brinks Hofer Gilson & Lione

[57] ABSTRACT

A pair of snap pieces, a connecting section for connecting these snap pieces and a pressing piece extending out of the connecting section into between both snap pieces are integrally formed with the metallic holding plate. The printed circuit board is mounted on the fixing plate for the see-saw operating type variable resistor and then the fixing plate is formed with the holding section for fixing the holding plate. This holding section has a pair of steps projecting from the bottom surface of the fixing plate, engaging holes formed at each of these steps and a pressing section bulged out over both steps, the both steps being oppositely faced to each other through the guide groove extending in a longitudinal direction of the bottom surface. Then, the flexible printed circuit board (FPC) is inserted into the pressing section and overlapped on the connecting section of the printed circuit board mounted on the bottom surface of the fixing plate, the holding piece of the holding plate is inserted into the pressing section, thereby the claw pieces of both snap pieces are snapped in the engaging holes and at the same time the pressing piece is deformed to cause each of the connector terminals of the printed circuit board and the FPC to be press contacted from each other.

4 Claims, 6 Drawing Sheets

CONNECTOR FOR FLEXIBLE PRINTED CIRCUIT BOARD

BACKGROUND OF THE INVENTION

1. Field of the Invention

This invention relates to a connector for a flexible printed circuit board for use in connecting the printed circuit board fixed on a fixing plate to an external circuit through the flexible printed circuit board.

2. Description of the Related Art

It is well-known in the art to apply a method in various kinds of electric parts such as variable resistors or switches in which a printed circuit board having some circuit patterns formed thereon is fixed on a metallic fixing plate and a flexible printed circuit board is overlapped on the printed circuit board and both connecting terminals are made to be electrically conductive in the case that the electric parts are actually loaded on a printed circuit board at a main body of equipment under application of this fixing plate, thereby the circuit patterns in the printed circuit board are connected to an external circuit through the flexible printed circuit board.

As a connector means applied between such a printed circuit board and a flexible printed circuit board as above, there has been proposed to provide a connector for the flexible printed circuit board comprised of a press contacting rubber mounted on the flexible printed circuit board overlapped on the printed circuit board and a holding member fixed to the printed circuit board through the press contacting rubber as already described in the gazette of Japanese Utility Model Laid-Open No. Hei 4-36779. This holding member is formed with an engaging piece and a snap piece, wherein after the engaging piece is inserted into a recess formed in the printed circuit board, the holding member is rotated with the recess as a fulcrum point, resulting in that the snap piece is engaged with the end surface of the snap piece.

In such a connector for flexible printed circuit board constructed as above, when the holding member is fixed to the printed circuit board together with the press contacting rubber in accordance with the aforesaid procedure under a state in which the flexible printed circuit board is overlapped on the printed circuit board, the flexible printed circuit board is forcedly contacted with the printed circuit board by a resilient force of the press contacting rubber placed between the holding member and the flexible printed circuit board, resulting in that each of the connector terminals of the printed circuit board and the flexible printed circuit board is connected to each other at their press contacted portions.

However, due to the fact that the prior art connector for the flexible printed circuit board described above was constructed such that the holding member was fixed to the printed circuit board through the press contacting rubber, resulting in that as the plate thickness size of the printed circuit board was made thin as the electric parts were made thin, there was a problem that the printed circuit board was deformed by a resilient force of the press contacting rubber, the positional displacement of the connector terminal was produced or poor contacted state was generated. In addition, since it was required to perform an operation to rotate the holding member with the recess as a fulcrum, a wide space allowing a rotation of the holding member had to be kept above the printed circuit board, resulting in that there was also present a problem that a space efficiency at the main body of the equipment was reduced.

SUMMARY OF THE INVENTION

The present invention is constructed such that as a member for connecting the flexible printed circuit board to the printed circuit board supported at the fixing plate, a holding member having a pressing piece extended between a pair of snap pieces is used and the pressing piece is inserted into a pushing part bulged out and formed at the fixing plate, thereby the pressing piece is deformed to cause the connector terminals of the printed circuit board and the flexible printed circuit board to be press contacted from each other and each of the snap pieces is engaged with the fixing plate outside the pressing part. With such a holding plate as above being used, the fixing of the holding plate is born not only by the snap pieces and the fixing plate, but also the flexible printed circuit board is press contacted with the printed circuit board supported on the fixing plate by a pressing contact force from the pressing piece, resulting in that it is possible to make a positive connection between the relative connector terminals of the printed circuit board and the flexible printed circuit board. In addition, as the pressing piece is being inserted into the pressing section, the snap pieces are automatically snapped in to the fixing plate, resulting in that a work for fixing the holding member to the fixing plate may become quite simple, and a mere pressing of the holding plate into the fixing plate is satisfactory for the operation and then the space efficiency at the main body side of the equipment can be improved.

The connector for the flexible printed circuit board of the present invention is comprised of a fixing plate formed with a pressing section bulged out against a bottom surface, a printed circuit board mounted on the bottom surface of the fixing plate and with its part being inserted into the aforesaid pressing section, a flexible printed circuit board inserted between these pressing section and the printed circuit board, and a metallic holding plate with a pressing piece being extended out between a pair of snap pieces, wherein the aforesaid pressing piece is inserted between the pressing section and the flexible printed circuit board, the relative connector terminals of the flexible printed circuit board and the printed circuit board are press contacted between the pressing piece and the fixing plate from each other and at the same time the aforesaid snap pieces are engaged with the aforesaid fixing plate outside the aforesaid pressing section.

With such an arrangement as above, it is possible to perform a positive connection of the connector terminals of the printed circuit board and the flexible printed circuit board through a simple work to insert the pressing piece of the holding plate into the pressing section of the fixing plate and at the same time it is possible to perform a positive fixing of the holding plate to the fixing plate.

In addition, the portion connecting the bottom surface of the fixing plate with the pressing section is formed with an opposing step through a guide groove, a position of each of the printed circuit board and the flexible printed circuit board is restricted in a width direction by the guide groove, resulting in that a lateral displacement between the printed circuit board and the flexible printed circuit board is prevented and a reliability in connecting operation can be improved more.

Additionally, the aforesaid fixing plate is provided with a stopper piece projected from the surface of the aforesaid printed circuit board and as an amount of insertion of the aforesaid flexible printed circuit board is restricted by the stopper piece, the extremity end of the flexible printed circuit board strikes against the stopper piece, and each of the connector terminals is restricted in its position against the inserting direction of the flexible printed circuit board, resulting in that a reliability in view of its connecting operation can be improved.

DETAILED DESCRIPTION OF THE PREFERRED EMBODIMENT

Figure 1:
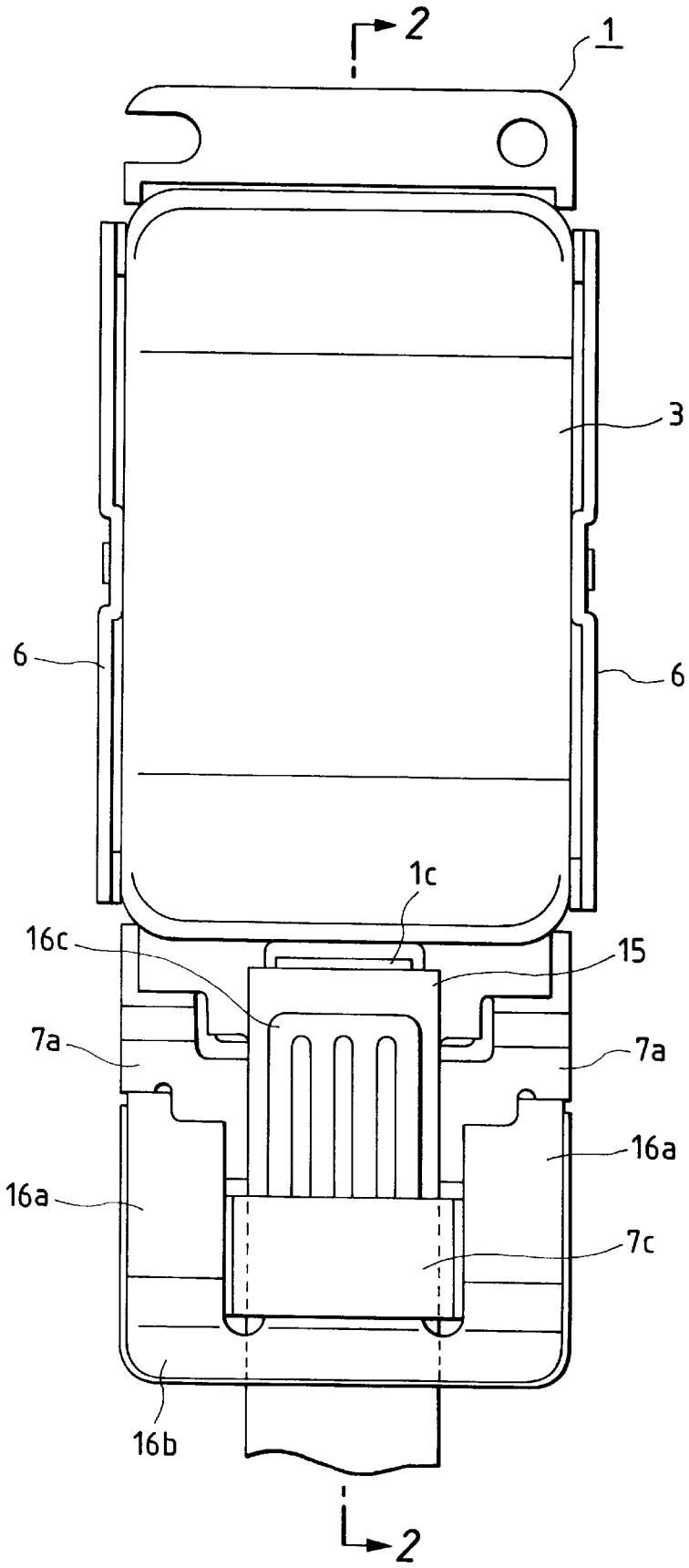
FIG. 1 is a top plan view for showing a see-saw operating type variable resistor applied in the preferred embodiment of the present invention.
Figure 2:
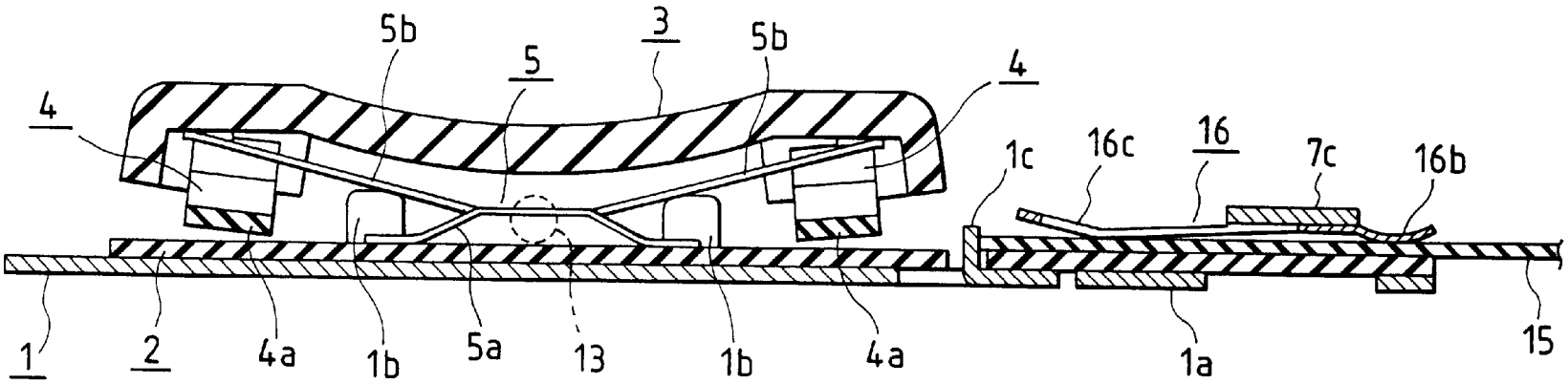
FIG. 2 is a sectional view taken along line 2—2 of FIG. 1.
Figure 3:
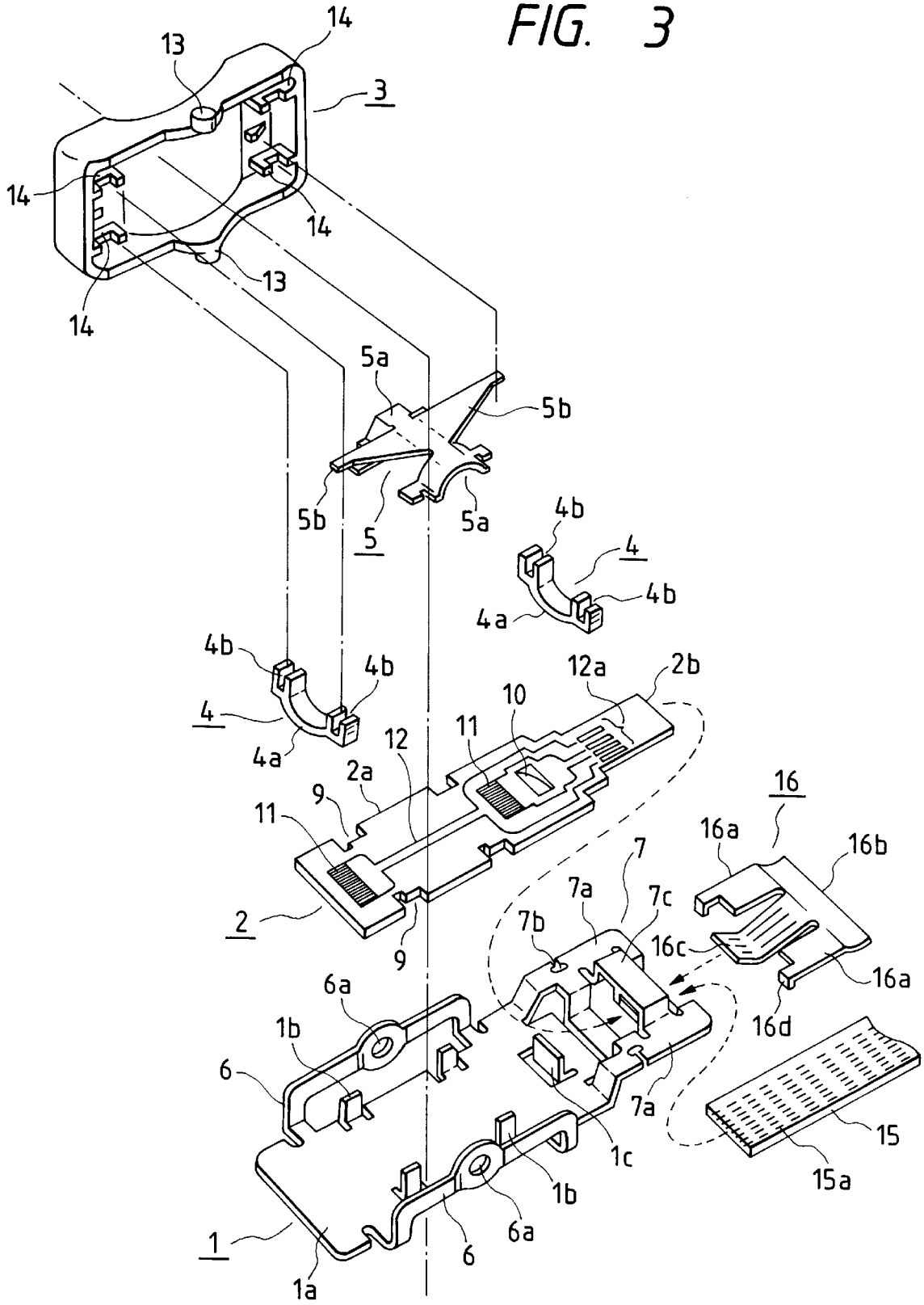
FIG. 3 is an exploded perspective view for showing the variable resistor.
Figure 4:
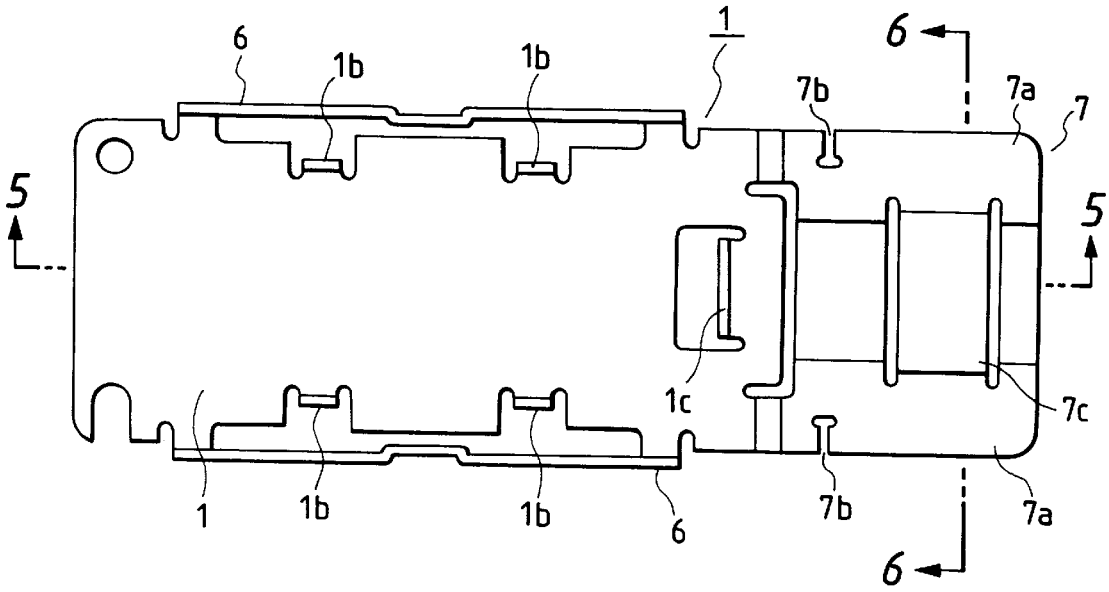
FIG. 4 is a top plan view for showing a fixing plate installed in the variable resistor.
Figure 5:
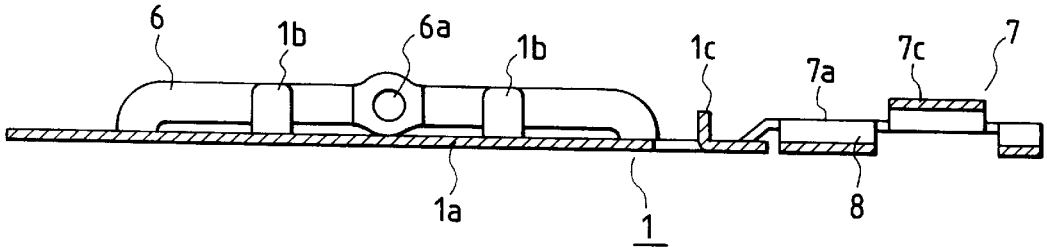
FIG. 5 is a sectional view taken along line 5—5 of FIG. 4.
Figure 6:
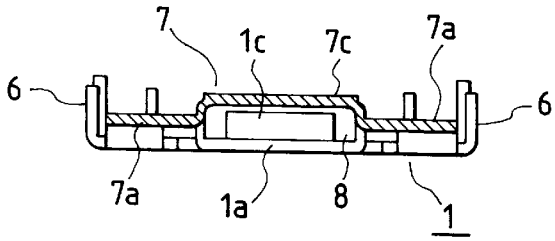
FIG. 6 is a sectional view taken along line 6—6 of FIG. 4.
Figure 7:
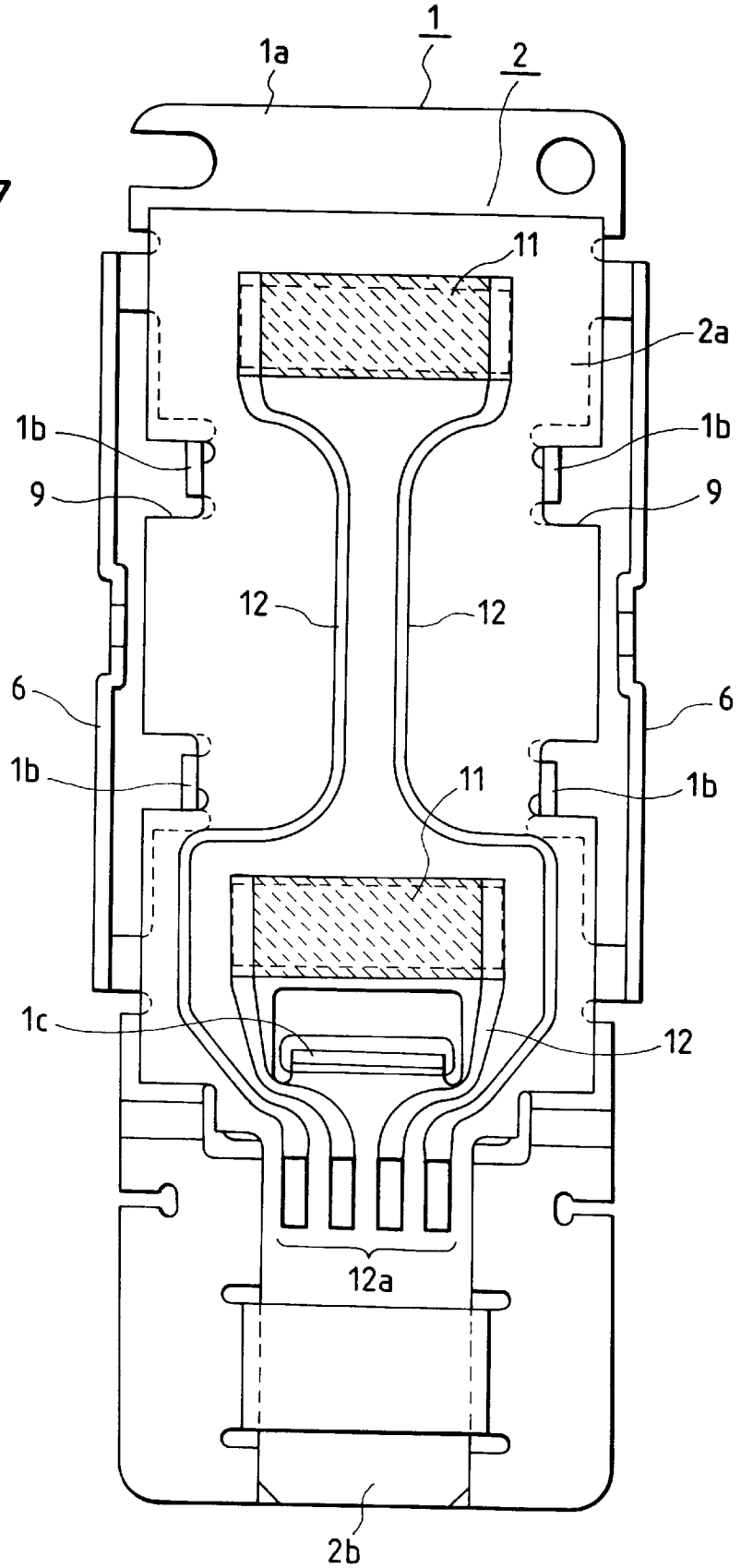
FIG. 7 is a top plan view for showing a state in which a printed circuit board is installed on the fixing plate.
Figure 8:
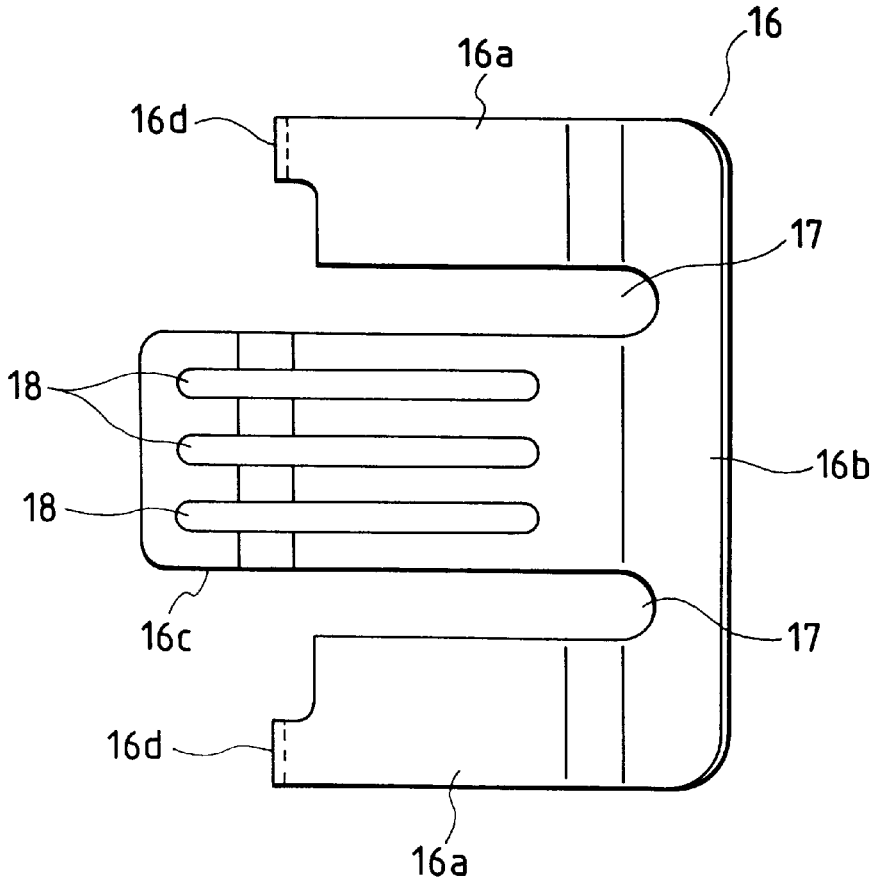
FIG. 8 is a top plan view for showing a holding plate installed at the variable resistor of FIG. 1.
Figure 9:
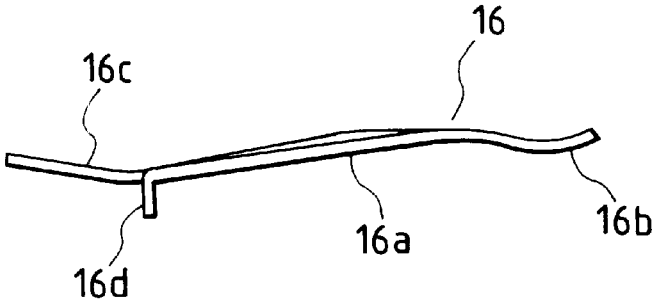
FIG. 9 is a side elevational view for showing the holding plate.

Referring now to the drawings, one preferred embodiment of the present invention will be described, wherein FIG. 1 is a top plan view for showing a see-saw operating type variable resistor applied in the preferred embodiment of the present invention; FIG. 2 is a sectional view taken along line 2—2 of FIG. 1; FIG. 3 is an exploded perspective view for showing the variable resistor; FIG. 4 is a top plan view for showing a fixing plate installed in the variable resistor; FIG. 5 is a sectional view taken along line 5—5 of FIG. 4; FIG. 6 is a sectional view taken along line 6—6 of FIG. 4; FIG. 7 is a top plan view for showing a state in which a printed circuit board is installed on the fixing plate; FIG. 8 is a top plan view for showing a holding plate installed at the variable resistor of FIG. 1; and FIG. 9 is a side elevational view for showing the holding plate.

At first, the see-saw operating type variable resistor to which the connector for the flexible printed circuit board in accordance with the preferred embodiment of the present invention is applied will be described, wherein this variable resistor is substantially comprised of a fixing plate 1 formed by metallic plate such as a stainless steel or the like, a printed circuit board 2 fixed on the fixing plate 1, an operating member 3 supported at the aforesaid fixing plate 1 in such a way that it may be operated in a see-saw manner, a pair of conductive rubbers 4 fixed to the operating member 3, and a return spring 5 for returning the aforesaid operating member 3 to its neutral position.

As shown in FIGS. 4 to 6, the aforesaid fixing plate 1 is entirely formed into a rectangle as seen in its top plan view, wherein a total number of four engaging claws, i. e. two engaging claws 1*b* for one side edge and two engaging claws 1*b* for the other side edge are bent at a right angle in an upward direction along both side edges extending in a longitudinal direction of the flat bottom surface 1*a*. In addition, bridge pieces 6 positioned outside each of the engaging claws 1*b* are bent at a right angle at both side edges of the bottom surface 1*a* in an upward direction and an axial hole 6*a* is formed at a central part of each of these bridge pieces 6. In addition, a stopper claw 1*c* is bent at a right angle at a rear part of the bottom surface 1*a* in an upward direction and a holding section 7 is integrally formed at the rear part of the stopper claw 1*c*. This holding section 7 is comprised of a pair of steps 7*a* formed more projecting than the bottom surface 1*a* of the fixing plate 1, engaging holes 7*b* formed at each of these steps 7*a* and a pressing section 7*c* bulged out over both steps 7*a*, wherein both steps 7*a* are opposite to each other through a guide groove 8 extending along a longitudinal direction of the bottom surface 1*a*.

The aforesaid printed circuit board 2 is comprised of insulating material such as phenol resin or epoxy resin containing glass therein and its size is set to a quite thin plate thickness size of about 0.5 mm. This printed circuit board 2 has a fixing section 2*a* having a rectangle as seen in its top plan view and a connecting section 2*b* projected from the rear end of the printed circuit board 2, wherein the fixing section 2*a* has four recesses 9 and one through hole 10. Each of the recesses 9 is fitted to an inside part of each of the aforesaid engaging claws 1*b*, thereby the fixing section 2*a* is mounted on the bottom surface 1*a* of the aforesaid fixing plate 1 with its position being restricted. At that time, the aforesaid stopper claw 1*c* passes through the through hole 10 and is projected above the printed circuit board 2, wherein the connecting section 2*b* is inserted into the pressing section 7*c* along the aforesaid guide groove 8. In addition, a pair of resistor members 11 are printed at the surface of the fixing section 2*a*, wherein these resistor members 11 are spaced apart by a predetermined clearance and extend in a horizontal direction of the fixing section 2*a*. Drawing patterns 12 are connected to both ends of each of these resistor members 11, a total number of four drawing patterns 12 extend up to the connecting section 2*b*, wherein each of the connector terminals 12*a* is formed on the connecting section 2*b*. Although not shown in the drawings, resist comprised of insulating paste is coated on the drawing patterns 12 except each of the connector terminals 12*a*.

The aforesaid operating member 3 is of a product molded by synthetic resin and entirely this is formed into a rectangle as seen in its top plan view. A pair of supporting shafts 13 are projected and formed at the central portions of both side surfaces extending along the longitudinal direction of the operating member 3, these supporting shafts 13 are inserted into the aforesaid axial holes 6*a*, thereby the operating member 3 is supported at the fixing plate 1 in such a manner that it may be operated in a see-saw way with each of the supporting shafts 13 as the fulcrum. In addition, four corners of the rear surface of the operating member 3 are formed with supporting protrusions 14.

The aforesaid conductive rubbers 4 are made of flexible material in which some conductive particles are dispersed in a resilient member such as a silicon rubber or the like, wherein its specific resistance is set to be a value which is sufficiently lower than that of the aforesaid resistor member 11. The central part of the conductive rubber 4 is formed to be curved in a protruded manner, wherein both ends of the curved section 4*a* are formed with a concave groove 4*b*. The conductive rubbers 4 are fixed to each of both ends of the rear surface of the aforesaid operating member 3 by fitting the concave groove 4*b* into the aforesaid supporting protrusion 14.

The aforesaid return spring 5 is comprised of a resilient metallic plate made of SUS or the like and has a pair of fixing sections 5*a* bent into a trapezoid form and arms 5*b* extending in a slant upward direction from between these fixing sections 5*a* and having a triangle shape as seen in its top plan view. The fixing sections 5*a* of the return spring 5 are mounted on the bottom surface 1*a* of the aforesaid fixing plate 1, and the positions of the four corners of the fixing sections 5*a* are restricted by the inner sides of their corresponding engaging claws 1*b* in a horizontal direction. In addition, the extremity ends of both arms 5*b* of the return spring 5 are adjacent to the rear surface of the aforesaid operating member 3 and the aforesaid substrate 2 is press contacted onto the bottom surface 1*a* of the fixing plate 1 with its repelling force.

Under the non-operating condition shown in FIG. 2 when the see-saw type operating variable resistor constructed as described above is used, the operating member 3 is kept at its neutral position due to resiliency of both arms 5*b* of the return spring 5 and the curved sections 4*a* of both conductive rubbers 4 are spaced apart by a predetermined gap with respect to the resistor 11 of the printed circuit board 2. When the left end of the operating member 3 shown in the figure, for example, is pressed from this state, the operating member 3 is operated like a see-saw manner in a counter-clockwise direction with each of the supporting shafts 13 as the fulcrum, and along with this operation, the curved section 4*a* of the left side conductive rubber 4 as seen in the figure comes into contact with one resistor member 11 and crushed by it. As a result, since the contacted area (a short section) between the curved section 4*a* of the conductive rubber 4 and the resistor member 11 is gradually widened as the see-saw operation of the operating member 3 is carried out, a resistance value of the resistor member 11 is changed in response to the contacted area. Additionally, as the aforesaid pressing force against the operating member 3 is removed, the operating member 3 is returned back to the neutral position shown in FIG. 2 by the return spring 5 and the curved section 4*a* of the conductive rubber 4 is also returned back to its original shape by its own resiliency. To the contrary, as the right end of the operating member 3 as seen in the figure is depressed, the operating member 3 is operated like a see-saw manner in a clockwise direction with each of the supporting shafts 13 as the fulcrum, the right side curved section 4*a* of the conductive rubber 4 as seen in the figure comes into contact with the other resistor member 11, thereafter it receives the pressing force of the operating member 3 to expand the contact area gradually, resulting in that the resistance value of the resistor member 11 is changed in response to this contact area.

Then, the connector for the flexible printed circuit board for use in transmitting a variation in resistance value outputted from the printed circuit board 2 of the aforesaid see-saw operating type variable resistor to an external circuit will be described, wherein this connector is provided with a holding plate 16 for use in connecting each of the connector terminals 12*a* on the printed circuit board 2 with each of the connector terminals 15*a* of the flexible printed circuit board (hereinafter called as FPC). As shown in FIGS. 8 and 9, the holding plate 16 is comprised of a resilient metallic plate such as stainless steel, SUS (as defined in Japanese Industrial Standard G4304) or the like, wherein a pressing piece 16*c* is extended out of a connecting section 16*b* connecting a pair of snap pieces 16*a*, and a recess 17 is formed between these snap pieces 16*a* and the pressing piece 16*c*. Claw pieces 16*d* are bent at a right angle in a downward direction at the extremity ends of both snap pieces 16*a* and formed there, wherein the connecting section 16*b* is curved in a downward direction in a protruded shape. In addition, the pressing piece 16*c* is bent into a dogleg shape and then a plurality of slits 18 are formed.

In the case that the aforesaid printed circuit board 2 and FPC 15 are connected by applying the holding plate 16 constructed as described above, at first, the FPC 15 is inserted into the pressing section 7*c* of the fixing plate 1 installed at the see-saw operating type variable resistor and the FPC 15 is overlapped on the connecting section 2*b* of the printed circuit board 2 mounted on the bottom surface 1*a* of the fixing plate 1. At that time, the extremity end of the FPC 15 strikes against the stopper claw 1*c*, an amount of insertion of the FPC 15 is mechanically restricted, so that each of the connector terminals 12*a* of the printed circuit board 2 and each of the connector terminals 15*a* of the FPC 15 are accurately set in their positions in respect to an inserting direction and further the connecting section 2*b* of the printed circuit board 2 and the FPC 15 are inserted along the guide groove 8, resulting in that each of the connector terminals 12*a*, 15*a* is also accurately set in position in a width direction crossing at a right angle with the inserting direction. Under this state, when the pressing piece 16*c* of the holding plate 16 is being inserted into the pressing section 7*c*, both snap pieces 16*a* are slid on step sections 7*a* positioned at both sides of the pressing section 7*c* and the claw piece 16*d* of the extremity end is snapped in the engaging hole 7*b*, thereby as shown in FIG. 1, the holding plate 16 is fixed in snap to the holding section 7 of the fixing plate 1. As a result, as shown in FIG. 2, since the part near the root section of the pressing piece 16*c* is compressed and deformed between the pressing section 7*c* of the fixing plate 1 and a plane 1*a* connecting the printed circuit board fixed on the bottom fixing plate to an external circuit through the flexible printed circuit board, each of the connector terminals 12*a*, 15*a* of the printed circuit board 2 and the FPC 15 are press contacted to each other by the dogleg shaped bent portion of the pressing piece 16*c*, receive a uniform force through slits 18 and they are reliably connected from each other. Also at a location other than a place where each of the connector terminals 12*a*, 15*a* is overlapped from each other, the printed circuit board 2 and the FPC 15 are pressed by the connecting section 16*b*, so that a pulling-out of the FPC 15 is prevented reliably and at the same time the deformation of the pressing piece 16*c* under application of external force is also prevented.

As described above, in the aforesaid preferred embodiment, each of the connector terminals 12*a*, 15*a* of the printed circuit board 2 and the FPC 15 can be connected reliably under a simple operation of insertion of the pressing piece 16*c* of the holding plate 16 into the pressing section 7*c* of the fixing plate 1, and further the holding plate 16 is fixed to the fixing plate 1 under application of another snap piece 16*a* different from the pressing piece 16*c*, resulting in that it is possible to use the printed circuit board 2 having a thin wall thickness and subsequently it can be accommodated for a thin formation of the see-saw operating type variable resistor.

In addition, since the connecting section 2*b* of the printed circuit board 2 and the FPC 15 are restricted in their positions by the guide groove 8, the operation for inserting the connecting section 2*b* and the FPC 15 into the pressing section 7*c* is made simple and at the same time a lateral displacement of each of the connecting section 2*b* and the FPC 15 can be prevented and a reliability in connecting operation between each of the connector terminals 12*a*, 15*a* can be increased.

Additionally, since an amount of insertion when the FPC 15 is inserted into the pressing section 7*c* is restricted mechanically by the stopper claw 1*c*, the position of each of the connector terminals 12*a*, 15*a* is also restricted against the inserting direction of the FPC 15 and also in view of this fact, a reliability in connecting operation between each of the connector terminals 12*a*, 15*a* can be increased.

Further, since each of the pressing pieces 16*c* divided by a plurality of slits 18 is forcedly contacted with each of the connector terminals 15*a* of the FPC 15, a pressing load. applied from the pressing piece 16*c* is concentrated at the overlapped portions of each of the connector terminals 12*a*, 15*a* and also in view of this fact, it is possible to increase a reliability in connecting operation between each of the connector terminals 12*a*, 15*a*.

Further, although the case in which the connector for the flexible printed circuit board of the present invention is applied to the see-saw operating type variable resistor has been described in the aforesaid preferred embodiment, it is of course apparent that the present invention can be applied to the system other than the see-saw operating type variable resistor if this is an electrical component of type in which the printed circuit board fixed on the fixing plate is connected to an external circuit through the flexible printed circuit board.

Many widely different embodiments of the invention may be constructed without departing from the spirit and the scope of the present invention. It should be understood that the present invention is not limited to the specific embodiments described in the specification, except as defined in the appended claims.

What is claimed is:

1. A connector for a flexible printed circuit board, comprising:

a fixing plate formed with a pressing section bulged out against a bottom surface thereof;

a printed circuit board having a fixing section and a connecting section, said printed circuit board mounted on the bottom surface of the fixing plate and with said connecting section being inserted into said pressing section;

the flexible printed circuit board inserted between the pressing section and said connecting section of the printed circuit board; and a metallic holding plate with a pressing piece being extended out between a pair of snap pieces, wherein said pressing piece is inserted between said pressing section and said flexible printed circuit board, thereby the relative connector terminals of the flexible printed circuit board and said connecting section of the printed circuit board are press contacted between said pressing piece and said fixing plate from each other and at the same time said snap pieces are engaged with said fixing plate outside said pressing section.

2. A connector for a flexible printed circuit board according to claim 1, wherein said fixing plate is provided with a stopper piece projected from the surface of said printed circuit board and an amount of insertion of said flexible printed circuit board is restricted by the stopper piece.

3. A connector for a flexible printed circuit board according to claim 1, wherein a portion connecting the bottom surface of said fixing plate with said pressing section is formed with steps opposite to each other through a guide grove; and a position of said connecting section of the printed circuit board and said flexible printed circuit board is restricted in a width direction by the guide groove.

4. A connector for a flexible printed circuit board according to claim 3, wherein said fixing plate is provided with a stopper piece projected from the surface of said printed circuit board and an amount of insertion of said flexible printed circuit board is restricted by the stopper piece.

* * * * *